US007921862B1

(12) United States Patent
Mueller

(10) Patent No.: US 7,921,862 B1
(45) Date of Patent: Apr. 12, 2011

(54) TENT FRAME AND TENT APPARATUS

(76) Inventor: Dick Mueller, Omaha, NE (US)

( * ) Notice: Subject to any disclaimer, the term of this patent is extended or adjusted under 35 U.S.C. 154(b) by 0 days.

(21) Appl. No.: 12/653,015

(22) Filed: Dec. 7, 2009

(51) Int. Cl.
*E04H 15/24* (2006.01)

(52) U.S. Cl. ..... 135/100; 135/121

(58) Field of Classification Search ..... 135/100, 135/121, 128, 130, 133, 135, 137; 220/491, 220/495; 47/29.6
See application file for complete search history.

(56) References Cited

U.S. PATENT DOCUMENTS

| | | | | | |
|---|---|---|---|---|---|
| 577,151 | A | * | 2/1897 | Taylor | 220/491 |
| 900,637 | A | * | 10/1908 | Young | 220/495 |
| 912,184 | A | * | 2/1909 | Scott | 47/29.6 |
| 1,037,539 | A | * | 9/1912 | Rodgers | 220/495 |
| 1,124,420 | A | | 1/1915 | Gough | |
| 1,794,076 | A | * | 2/1931 | Jablons | 248/167 |
| 1,865,533 | A | * | 7/1932 | Lutzke | 220/485 |
| 1,995,489 | A | * | 3/1935 | Valasck | 135/120.3 |
| 2,014,175 | A | * | 9/1935 | Hart | 47/29.6 |
| 2,051,596 | A | * | 8/1936 | Harbaugh | 47/29.5 |
| 2,953,145 | A | | 9/1960 | Moss et al. | |
| 3,794,054 | A | | 2/1974 | Watts | |
| 3,929,146 | A | | 12/1975 | Maiken | |
| 4,033,366 | A | | 7/1977 | Forget | |
| 4,945,936 | A | | 8/1990 | Surrendi | |
| 5,293,890 | A | | 3/1994 | Park et al. | |
| 6,213,138 | B1 | | 4/2001 | Wimpee | |
| 6,725,873 | B2 | | 4/2004 | Liu | |
| 7,341,071 | B2 | | 3/2008 | Lee | |
| 2006/0289048 | A1 | | 12/2006 | Choi | |

* cited by examiner

*Primary Examiner* — David Dunn
*Assistant Examiner* — Noah Chandler Hawk
(74) *Attorney, Agent, or Firm* — Dennis L. Thomte; Thomte Patent Law Office LLC

(57) ABSTRACT

An improved frame for tents and structures comprising a generally circular base plate, a plurality of main frame support struts, each including a lower leg section, a generally upright center section, and an upper section such that each of the support struts is generally C-shaped in side elevational view and an indexing ring mounted on the lower face of the base plate which includes a plurality of lower leg section retaining notches circumferentially spaced around the indexing ring to releasably engage and retain the lower leg sections of the main frame support struts. Upper and lower strut connectors pivotably connect the upper ends and lower ends of the struts to one another. A generally circular frame extension ring engages retaining notches of the main frame support struts between the center section and upper sections thereof such that the base plate and frame extension ring retain the main frame support struts in an upright, circumferentially spaced orientation.

7 Claims, 6 Drawing Sheets

TENT FRAME AND TENT APPARATUS

BACKGROUND OF THE INVENTION

1. Field of the Invention

The present invention relates to frames for tents and, more particularly, to an improved tent apparatus.

2. Description of Related Art

There are an enormous number of types of tent frames and assemblies which are used in connection with tent structures, both large and small. In general, tent frames include a plurality of upright struts which interact to support a nylon or canvas material which is spread over the frame or which is engaged and supported by the frame, depending on the exact nature of the frame being used to hold the tent in its use position. The interior of the tent may then provide protection for persons, animals, or things placed therein. Of course, tents are used for many different purposes, but one of the more unique uses for tents is for the housing of small pets such as dogs and cats. Regardless of the intended use of the tent, however, it is a significant requirement that the frame of the tent be quickly and easily erectable yet be safe, sturdy, and secure once it has been erected. Although many different types of tent frames have been proposed in the prior art, including such tent frames as Lee, U.S. Pat. No. 7,341,071, Liu, U.S. Pat. No. 6,725,873, and Wimpee, U.S. Pat. No. 6,213,138, none of these prior are devices disclose a tent frame which may be easily adapted for both very small and very large tent structures, specifically those designed for use by small pets in addition to those designed for use by humans. There is, therefore, a need for an improved tent frame which addresses and solves the deficiencies found in the prior art.

BRIEF SUMMARY OF THE INVENTION

The present invention provides an improved frame for tents and tent apparatus. In one aspect, the tent frame comprises a base plate having a lower face and a plurality of main frame support struts. Each of the support struts has a lower leg section, a generally upright center section, and an upper section such that each of the plurality of main frame support struts is generally C-shaped in side elevational view. A lower indexing means is mounted on the lower face of the base plate. The lower indexing means includes a plurality of lower leg section retaining notches spaced around the indexing means to releasably engage and retain one of the lower leg sections of the main frame support struts upon the lower leg section being inserted therein.

In another aspect, the tent frame comprises upper and lower strut connectors which extend between and connect each of the upper sections of the main frame support struts and the lower sections of the main frame support struts. In a preferred aspect, the upper and lower strut connectors comprise a generally circular ring.

In still another aspect, the present invention includes a frame extension ring which engages each of the plurality of main frame support struts between the center section and upper section thereof. In a preferred aspect, the frame extension ring is generally circular in shape.

It will be appreciated that the lower indexing means, base plate, and frame extension ring cooperate to releasably secure the plurality of main frame support struts in upright, generally circumferentially spaced orientations around the base plate and extension ring, thereby forming the improved frame of the present invention.

It is thus seen that the improved frame of the present invention provides a substantial improvement over those frames described and shown in the prior art. For example, the lower indexing means and frame extension ring cooperate to releasably engage and secure the main frame support struts in their circumferentially spaced positions, thus significantly reducing the opportunity for unintentional adjustment or slippage of the position of the main frame support struts relative to one another, a situation which often causes failure of the tent frame.

In yet a further aspect, because the base plate is supported above the ground surface on which the frame is resting, due to the positioning of the lower leg sections underneath the base plate, many of the problems associated with tent floors are eliminated as the present invention is designed to prevent the tent floor from contacting the ground surface directly. Finally, as will be seen later in this disclosure, the ease with which the improved frame of the present invention is erected far exceeds the ease of erection procedures associated with the prior art. It is therefore clear that the present invention provides a substantial improvement over those devices and methods found in the prior art.

In another aspect, the present invention provides an improved frame for tents which may quickly and easily be covered by the tent cover material to complete construction of the tent following erection of the frame.

Finally, the present invention is directed to an improved frame for tents which is relatively simple to manufacture and which is safe, effective, and efficient in use.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 3A illustrates the base plate and lower indexing ring. FIG. 3B illustrates the frame support struts, and FIG. 3C illustrates the extension ring, upper indexing disc, and spire.

DETAILED DESCRIPTION OF PREFERRED EMBODIMENT

Figure 1:
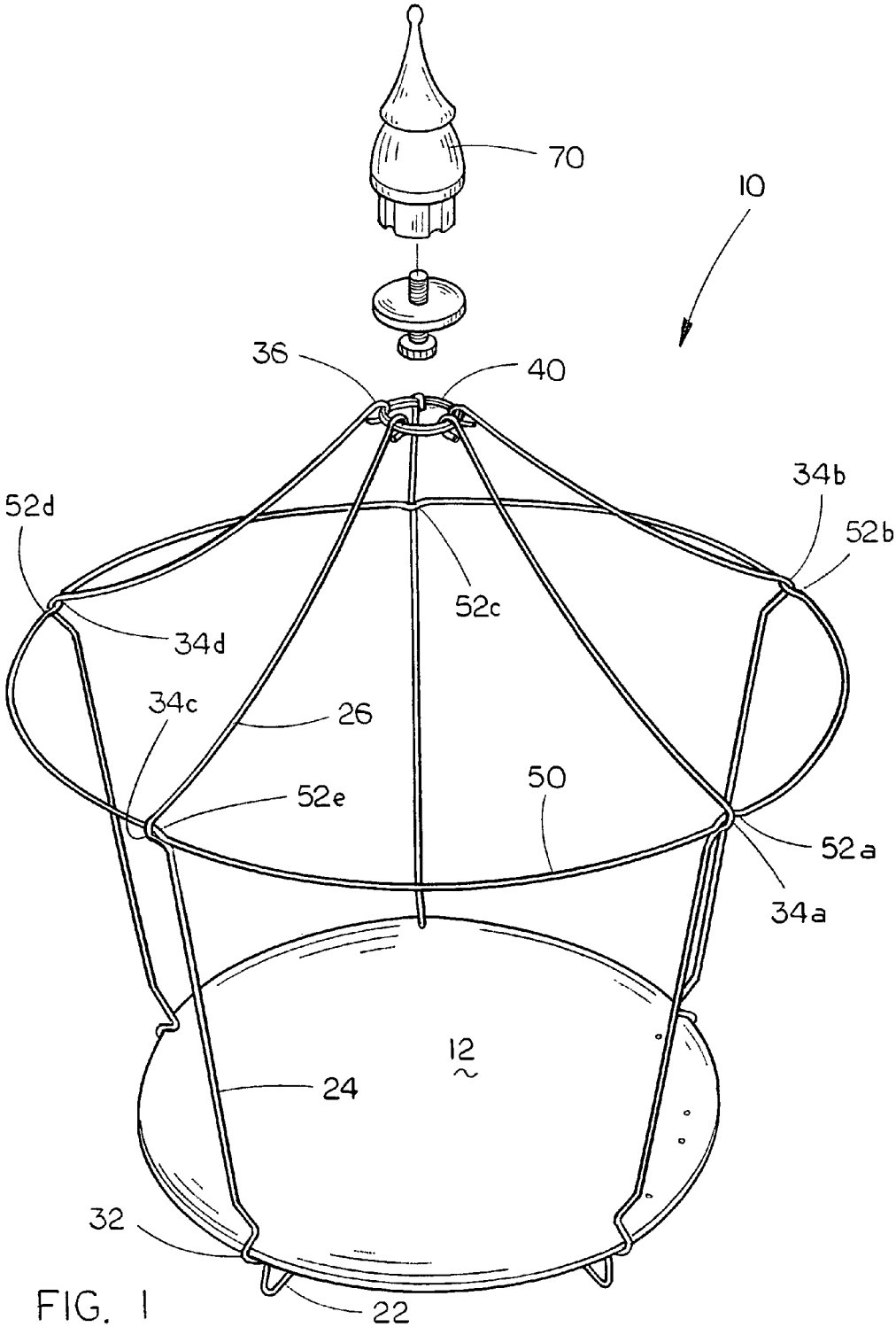
FIG. 1 is a perspective view of the improved frame for tents of the present invention.

The improved tent frame 10 of the present invention is best shown in FIGS. 1-6 as including a base plate 12 which, in the preferred embodiment, is a generally flat circular plate constructed of a pressboard-type material such as plywood, plastic, metal, or the like, although the construction material used in connection with the base plate 12 is not particularly critical to the present invention so long as the base plate 12 provides a sturdy, solid base for the improved frame 10 of the present invention. Mounted on the lower face or underside 13 of base plate 12 is a lower indexing means for locating a plurality of main frame support struts 20, as discussed more fully below. The lower indexing means releasably engages and retains the lower leg sections of the plurality of main frame support struts 20. The lower indexing means preferably comprises a lower indexing ring 14, which includes a plurality of equidistantly and circumferentially spaced retaining notches 16*a*, 16*b*, 16*c*, 16*d*, and 16*e* formed in the surface of the lower indexing ring 14 and extending downwards therein. In the preferred embodiment, each of the retaining notches 16*a-e* has generally a U-shaped cross-sectional shape, as shown best in FIGS. 3A and 4. It is further preferred that the sections of the indexing ring 14 between the retaining notches 16*a-e* be slightly concave in shape so that the highest points on the indexing ring 14 are the edges of the retaining notches 16*a-e* in order to facilitate movement of the main frame support struts 20. It is further preferred that the indexing ring 14 be constructed of a high impact plastic material such as ultra high molecular weight polyethylene ("UHMW-PE"), although the precise manufacturing material used in connection with the indexing ring 14 is not particularly critical to the invention so long as the functionality of the indexing ring 14 is neither substantially degraded nor destroyed. Further, while the indexing ring 14 is shown as being generally circular in shape, the size and shape of the indexing ring may be adjusted to correspond to the overall shape of the tent frame 10.

Figure 2:
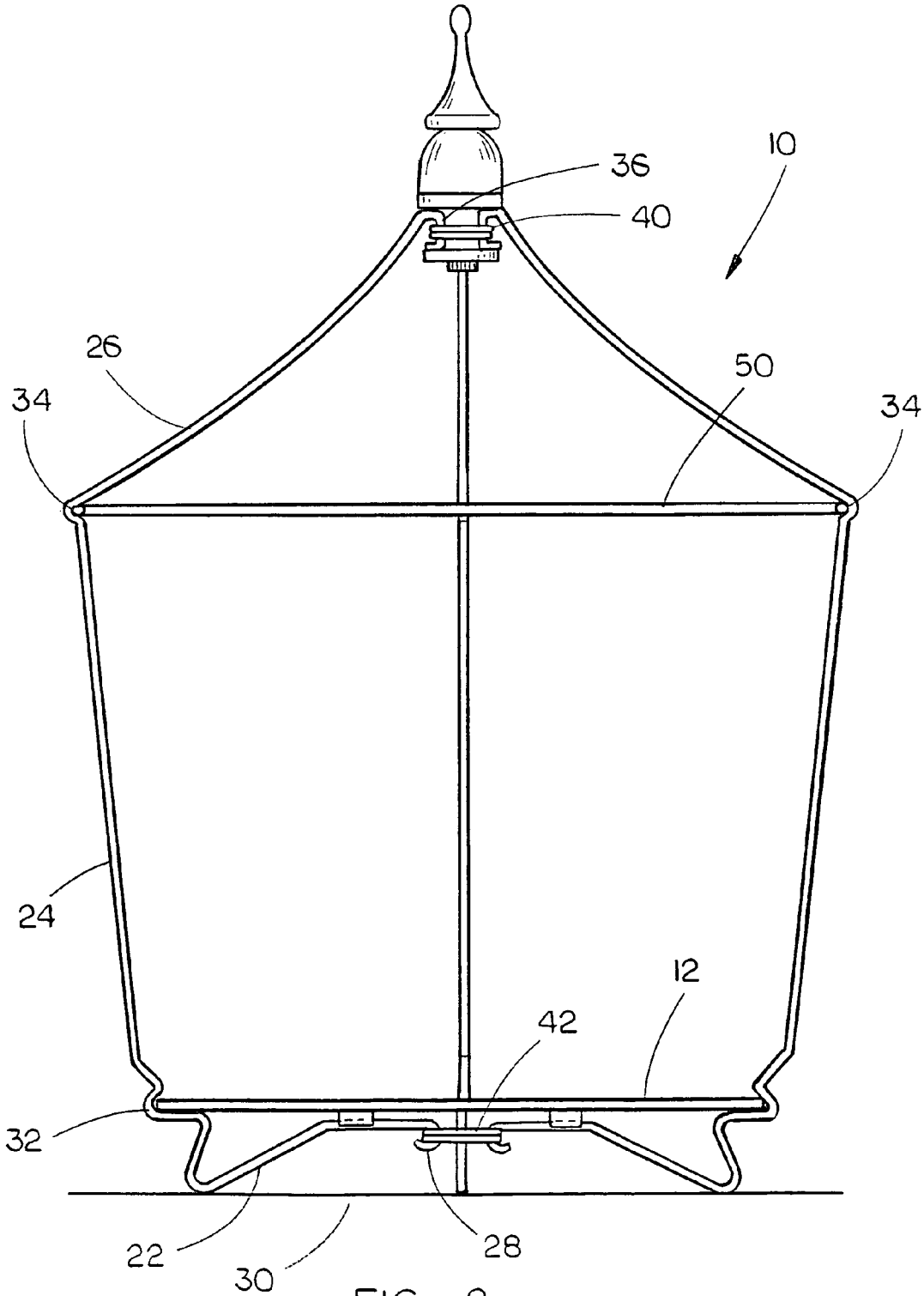
FIG. 2 is a side elevational view of the frame and the main frame support struts showing the curvatures and elements thereof.
Figure 3C:
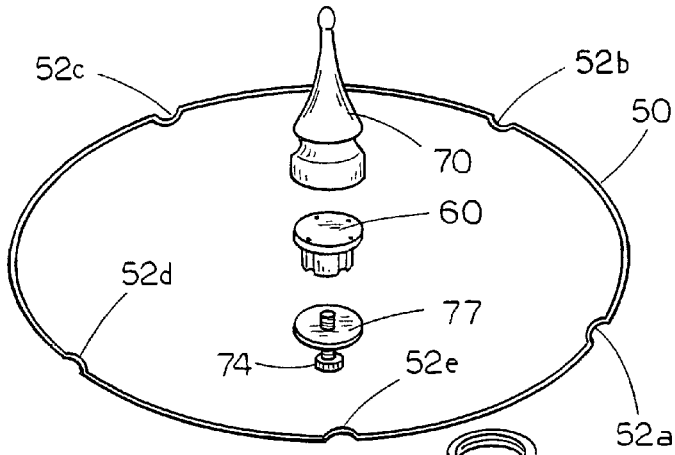
FIGS. 3A-C are a perspective view of each of the elements of the present invention prior to being assembled. More specifically.
Figure 3B:
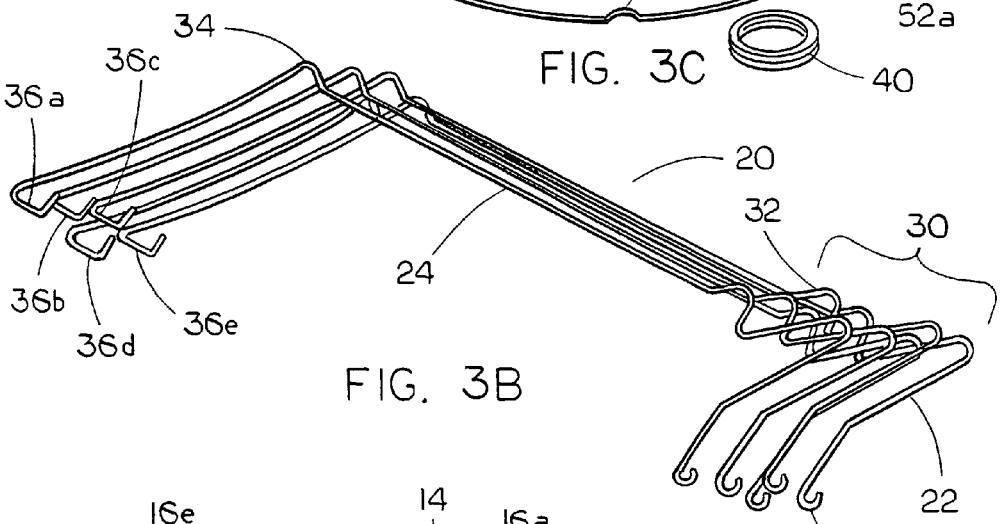
Figure 3A:
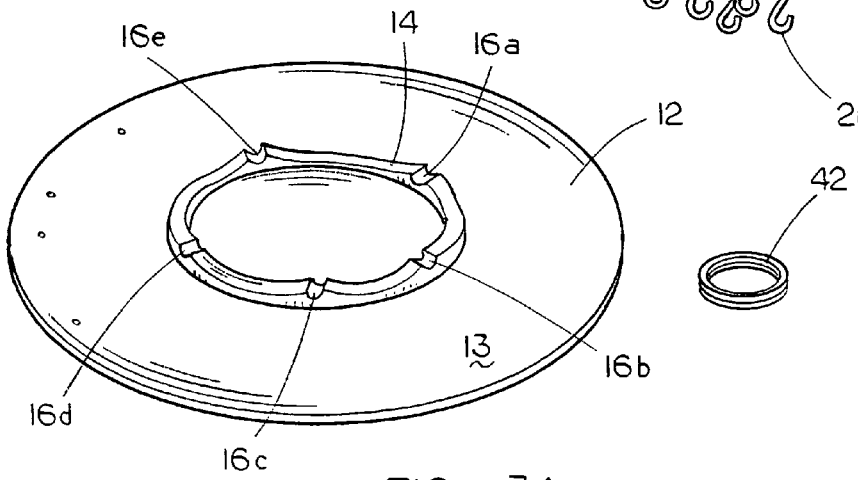
Figure 4:
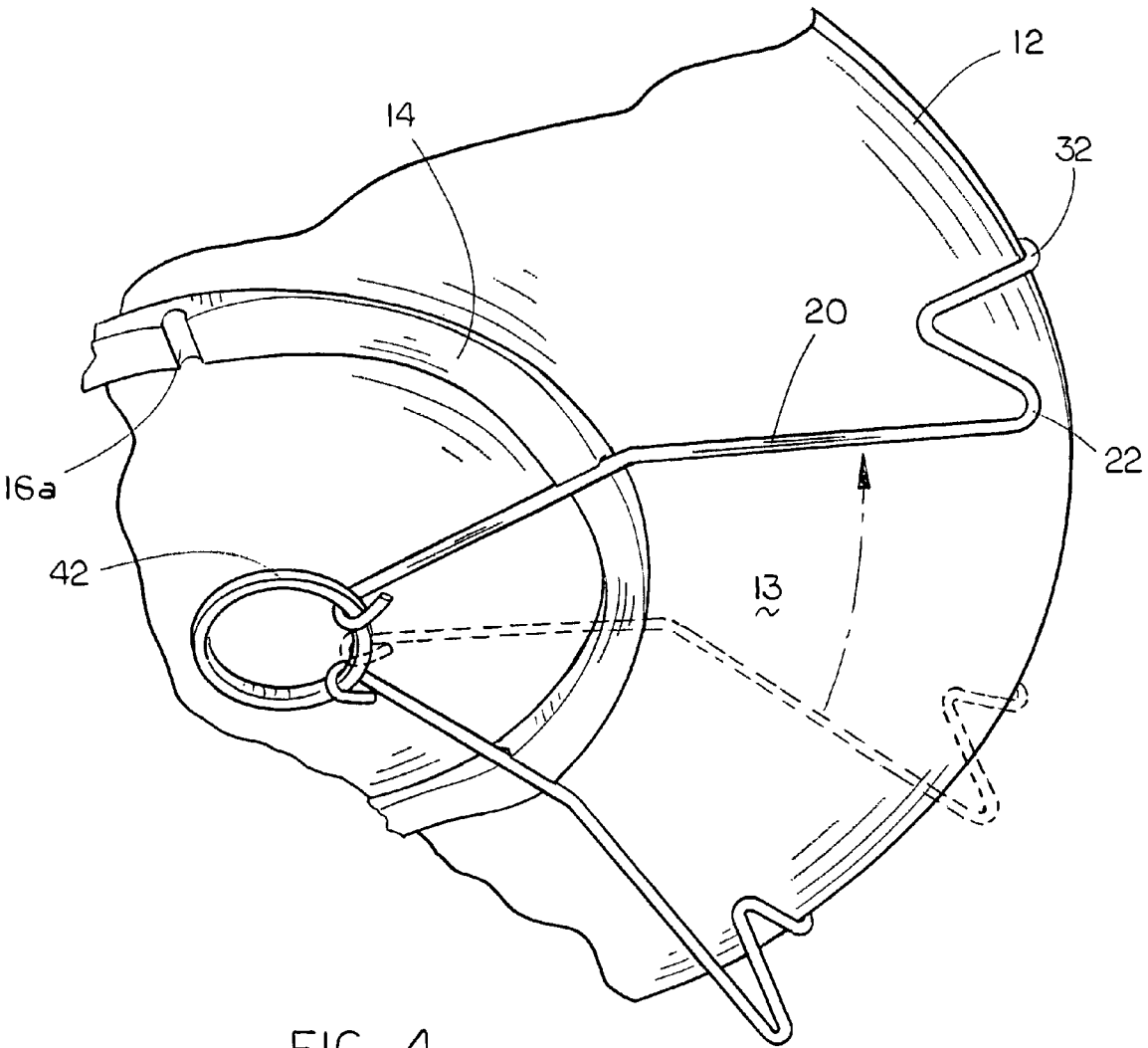
FIG. 4 is a detailed bottom perspective view of the present invention showing the main frame support struts being secured in a particular spaced configuration by the indexing ring.

A plurality of main frame support struts 20*a*, 20*b*, 20*c*, 20*d*, and 20*e* provide the main framework for the improved frame 10 of the present invention, as shown best in FIGS. 1, 2, and 3B. In the preferred embodiment, each of the main frame support struts 20*a-e* is generally identical to one another, and therefore, the following description of main frame support strut 20*a* should be understood to apply generally to the remaining main frame support struts 20*b-e*. Main frame support strut 20*a* preferably includes three (3) main sections: a lower leg section 22 which engages the ground, a generally upright center section 24, and an upwardly angled upper section 26. The lower leg section 22, the center section 24, and the upper section 26 preferably form a general C-shape when viewed in a side elevational view as illustrated in FIG. 2. Lower leg section 22 preferably extends generally horizontally and includes a lower connection eye 28 at the one end thereof and a leg 30 which is formed via bending portions of the lower leg section 22, as shown best in FIG. 2. The connection or transition of the lower leg section 22 to the center section 24 preferably include a base plate-receiving notch 32. From this point, the center section 24 extends upwardly, preferably at a slight outward angle. The center section 24 extends upwards to connect to the upper section 26, and the connection or transition between the center section 24 and upper section 26 preferably includes an extension ring-receiving notch 34. Finally, the end of the upper section 26 preferably includes an upper connection eye 36. It should be noted that the angles and curvatures of the various elements of the main frame support strut 20*a* as discussed above may be adjusted to present various sizes and shapes of structures for the improved frame 10, but the basic elements described in connection with main frame support strut 20*a* should preferably be included to ensure proper functionality of the present invention. The struts 20*a* are preferably constructed of a generally rigid material, such as plastic or metal wire.

Each of the main frame support struts 20*a-e* are connected to one another at the upper and lower ends thereof via upper and lower strut connectors. Preferably, the upper and lower strut connectors are generally circular upper and lower connection rings 40 and 42, which pass through each of the upper and lower connection eyes 36 and 28 before being closed. Thus, the main frame support struts 20*a-e* may be pivoted relative to one another while still being connected to one another to ensure a reasonably strong and sturdy structural configuration. The present invention also includes a generally circular frame extension ring 50 which, in the preferred embodiment, has a diameter at least equal to or greater than the diameter of the base plate 12. The extension ring 50 may also include a plurality of spaced engagement notches 52*a*, 52*b*, 52*c*, 52*d*, and 52*e* which align with the extension ring-receiving notches 34 in the support struts 20 to releasably secure the extension ring 50 in its engagement position with the main frame support struts 20*a-e*. The extension ring 50 is constructed of a similar material to that used in construction of the main frame support struts 20*a-e*, namely a generally rigid metal wire material.

Figure 5:
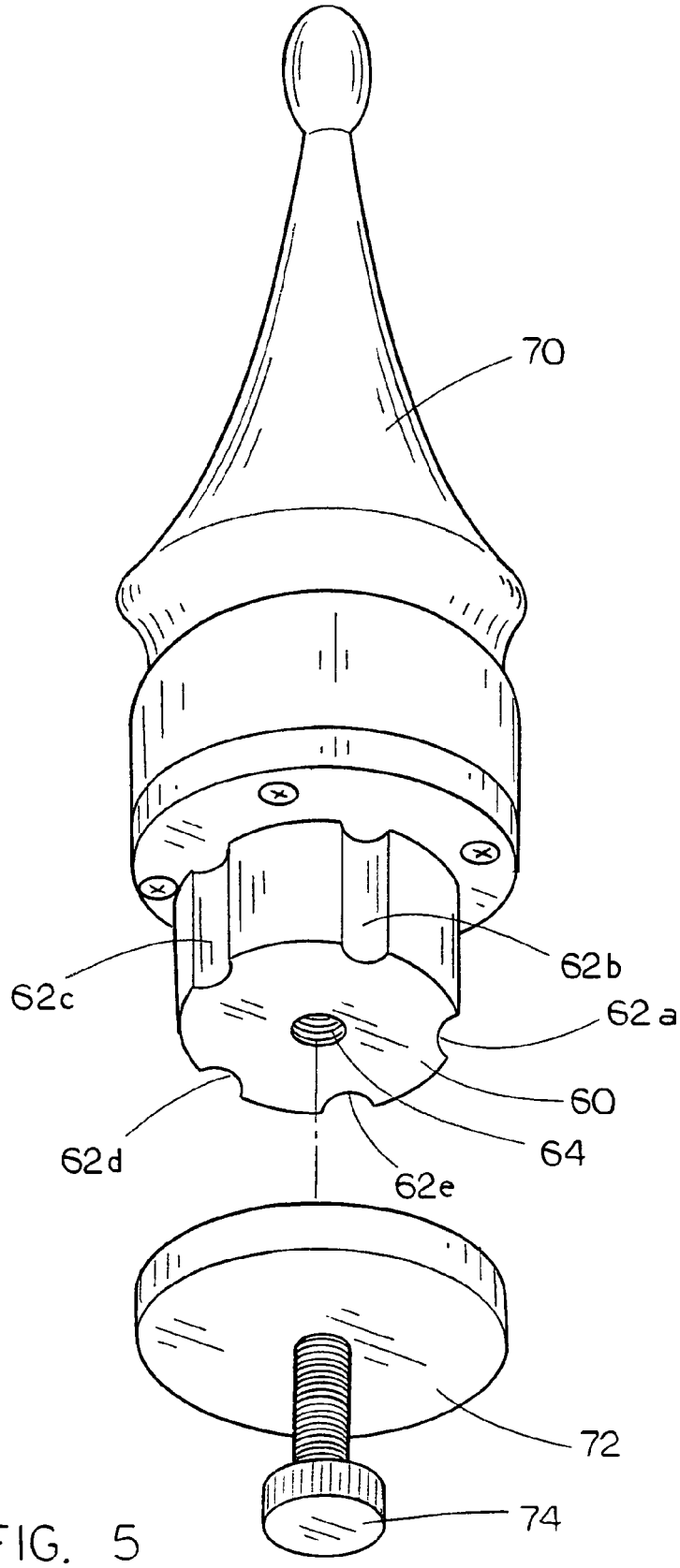
FIG. 5 is a detailed perspective view of the upper indexing disc and top spire.

An upper indexing means, such as a disc 60, is preferably utilized with the upper connection ring 40 to provide additional structural rigidity to the improved frame 10 of the present invention, as shown in FIGS. 2 and 5. The upper indexing means releasably engages and retains the upper sections of the plurality of main frame support struts. In the preferred embodiment, the indexing disc 60 includes a plurality of upper connection eye engagement notches 62*a*, 62*b*, 62*c*, 62*d*, and 62*e* which engage the upper connection eyes 36*a*, 36*b*, 36*c*, 36*d*, and 36*e* of the main frame support struts 20*a-e* in their circumferentially spaced positions on the upper connection ring 40. In the preferred embodiment, indexing disc 60 is constructed of a molded plastic material and includes a center hole 64 for use as will be described later in this disclosure.

Assembly of the improved frame 10 of the present invention is a relatively straightforward process and involves the following steps. The base plate 12 is inserted into the base plate-receiving notches 32 of the main frame support struts 20*a-e* with the lower connection ring 42 positioned approximately at the midpoint of the base plate 12. The lower leg section 22 of main frame support struts 20*a-e* engage the indexing ring 14 as shown best in FIG. 4. More specifically, the main frame support struts 20*a-e* are pivoted about the lower connection ring 42 and the upper connection 40 to bring each of the main frame support struts 20*a-e* into alignment with one of the retaining notches 16*a-e* in the lower indexing ring 14 as generally shown by the dotted line and arrow in FIG. 4. Because of the shape of the lower leg section 22, as the lower leg section 22 of each of the main frame support struts 20*a-e* slides over the indexing ring 14, it essentially "pops" into the desired retaining notch 16*a-e* once the main frame support strut 20 is positioned in its preferred location. Preferably, each of the main frame support struts 20*a-e* is spaced circumferentially and equidistantly around the perimeter of the base plate 12 as shown best in FIG. 1. The lower leg section 22 of each of the main frame support struts 20*a-e* are then retained in the retaining notches 16*a-e* of the indexing ring 14 and thus are maintained in their preferred spaced alignment to ensure structural integrity of the improved frame 10.

The extension ring 50 is then placed within the main frame support struts 20*a-e* and pulled upward until the extension ring 50 is engaged by each of the ring-receiving notches 34 in the main frame support struts 20*a-e*, as shown best in FIGS. 1 and 2. The extension ring 50 includes a plurality of spaced engagement notches 52*a*, 52*b*, 52*c*, 52*d*, and 52*e* which align with the ring-receiving notches 34 in the main frame support struts 20 to releasably secure the extension ring 50 in its engagement position with the main frame support struts 20*a-e*. Because of the diameter and circumference of extension ring 50, as the ring 50 is pulled upward into position engaging the main frame support struts 20*a-e*, a significant amount of tension is applied to the extension ring 50 by the main frame support struts 20*a-e* as they are deformed outward slightly. Because the main frame support struts 20*a-e* are constructed of a generally rigid material, the main frame support struts 20*a-e* pull inward against the extension ring 50 to secure the extension ring 50 in its engaged position and further reinforce the improved frame 10 of the present invention.

The upper indexing disc 60 is preferably then utilized with the upper connection ring 40 in the assembly process to provide additional structural rigidity to the improved frame 10 of the present invention, as shown in FIGS. 2 and 5. The eye engagement notches 62*a-e* in the indexing disc 60 engage a respective one of the upper connection eyes 36*a-e* of the main frame support struts 20*a-e* to retain the preferred spacing of the main frame support struts 20*a-e*. This upper indexing means 60, in connection with the spacing provided by lower indexing means 14, significantly contributes to the overall structural integrity of the improved frame 10.

Once the indexing disc 60 has been placed within upper connection ring 40, a decorative spire 70 may optionally be mounted on top of the improved frame 10. The decorative spire 70 is preferably constructed of wood or the like to enhance the overall appearance of the completed improved frame 10. The decorative spire 70 is preferably mounted atop the indexing disc 60 with a washer disc 72 being mounted underneath the indexing disc 60, and a securement screw 74 preferably extends upward through the disc washer 72, through the center hole 64 of indexing disc 60 and upward to be threadably retained within decorative spire 70. Of course, numerous other types of decorative top pieces may be used in connection with the improved frame 10 of the present invention, such as puff balls, signs or the like, any of which may be used in connection with the improved frame 10 of the present invention.

Figure 6:
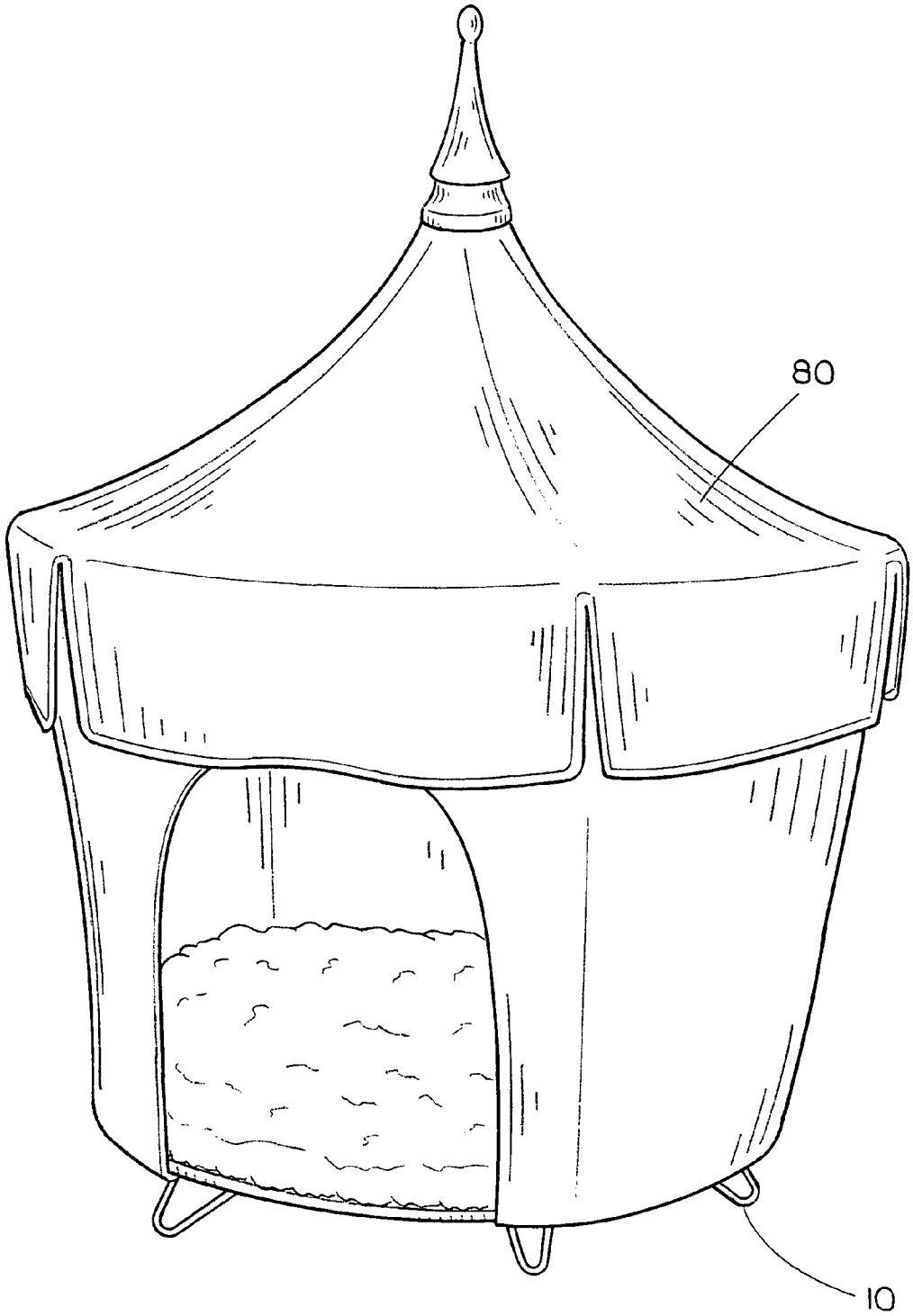
FIG. 6 is a perspective view of the completed tent with the tent cover placed over the improved frame of the present invention.

Finally, the tent cover 80 is extended over the improved frame 10 and secured in place thereon, as shown best in FIG. 6. It should be noted that the tent cover 80 is designed to conform to the general shape of the improved frame 10 and that virtually any type of fabric, material, pattern, and coloration may be used in connection with the tent cover 80 of the present invention so long as the tent cover 80 fits over and encloses the improved frame 10 of the present invention in the desired manner.

It is to be understood that numerous additions, modifications, and substitutions may be made to the improved frame 10 for tents of the present invention which fall within the intended broad scope of the appended claims. For example, the size, shape, and construction materials used in connection with the present invention may be modified or changed so long as the intended functional features are neither significantly degraded nor destroyed. Furthermore, it should be noted that the specific angles and curvatures of the main frame support struts 20*a-e*, base plate 12, and extension ring 50 may be modified to present different frame appearances, so long as the functional features of those elements remain generally intact. Also, although the improved frame 10 of the present invention has been described as being primarily designed for use with pet tents for small to medium size animals, by modifying the strength of the construction materials and size, and shape of the main frame support struts 20*a-e*, base plate 12, and extension ring 50, one may significantly expand the scope of use for the improved frame 10 of the present invention while retaining the functional features thereof. Finally, although the lower leg section 22 of each of the main frame support struts 20*a-e* has been described as including a leg 30, the leg 30 may be removed to permit the base plate 12, via the lower leg sections 22, to sit closer to the ground surface on which the improved frame 10 is to rest, should such a modification prove desirable.

There has, therefore, been shown and described an improved frame 10 for tents and structures which accomplishes at least all of its intended objectives. From the foregoing, it will be seen that this invention is one well adapted to attain all ends and objectives herein-above set forth, together with the other advantages which are obvious and which are inherent to the invention. Since many possible embodiments may be made of the invention without departing from the scope thereof, it is to be understood that all matters herein set forth or shown in the accompanying drawings are to be interpreted as illustrative, and not in a limiting sense. While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. An improved frame for tents comprising:

a base plate having a lower face;

a plurality of main frame support struts, each having a lower leg section, a generally upright center section, and an upper section;

a lower indexing means on said lower face of said base plate for releasably engaging and retaining said lower leg sections of said plurality of main frame support struts in an upright circumferentially spaced orientation about said base plate;

an upper strut connector and a lower strut connector, said upper strut connector extending between and connecting said upper sections of said plurality of main frame support struts, and said lower strut connector extending between and connecting said lower leg sections of said plurality of main frame support struts;

a frame extension ring extending between said plurality of main frame support struts; and an upper indexing means for releasably engaging and retaining said upper sections of the plurality of main frame support struts.

2. The improved frame for tents of claim 1 wherein said upper indexing means comprises an indexing disc having plurality of upper connection eye engagement notches for engaging upper connection eyes in said main frame support struts.

3. An improved frame for tents comprising:

a base plate having a lower face;

a plurality of main frame support struts, each having a lower leg section having a lower connection eye, a generally upright center section, and an upper section having an upper connection eye;

an indexing ring on said lower face of said base plate, said indexing ring having a plurality of lower leg section retaining notches, and wherein said lower leg section retaining notches engage said lower leg sections of said plurality of main frame support struts such that said base plate is supported on said lower leg sections;

an upper strut connection ring, said upper strut connection ring extending between and connecting said upper connection eyes in said upper sections of said plurality of main frame support struts, a lower strut connection ring, said lower strut connection ring extending between and connecting said lower connection eyes in said lower leg sections of said plurality of main frame support struts, a frame extension ring extending between said plurality of main frame support struts; and an upper indexing disc having a plurality of upper connection eye engagement notches for engaging the upper connection eyes in the main frame support struts.

4. The improved frame for tents of claim 3 wherein said upper indexing disc has a hole, said hole adapted to receive a securement screw for a spire.

5. A method for constructing a tent frame comprising:

providing a plurality of main frame support struts, each of said struts having a lower leg section having a lower connection eye, a generally upright center section, and an upper section having an upper connection eye;

providing a base plate having a lower face with an indexing ring thereon, said indexing ring having a plurality of lower leg section retaining notches;

inserting said lower leg sections of said plurality of main frame support struts into said lower leg section retaining notches of said indexing ring such that said base plate is supported on said lower leg sections of said main frame support struts;

connecting said plurality of said main frame support struts by engaging said lower connection eyes with a lower strut connection ring;

inserting a frame extension ring extending between said plurality of main frame support struts; and connecting said plurality of said main frame support struts by engaging said upper connection eyes with an upper strut connection ring; and inserting an upper indexing means for releasably engaging and retaining said upper sections of the plurality of frame support struts.

6. The method for constructing a tent frame of claim 5 wherein said upper indexing means comprises an indexing disc having plurality of upper connection eye engagement notches, and comprising the step of engaging said upper connection eyes in the main frame support struts with said upper connection eye engagement notches.

7. The method for constructing a tent frame of claim 5 further comprising the step of securing a spire to said indexing disc.

* * * * *